United States Patent [19]

Miller

[11] 4,197,032

[45] Apr. 8, 1980

[54] APPARATUS AND METHOD FOR FORMING A CONTINUOUS STRIP OF PAVING

[75] Inventor: Joseph V. Miller, Salisbury, N.C.

[73] Assignee: Power Curbers, Inc., Salisbury, N.C.

[21] Appl. No.: 930,430

[22] Filed: Aug. 2, 1978

[51] Int. Cl.[2] ..... E01C 11/28

[52] U.S. Cl. ..... 404/98; 299/73; 299/87; 404/105; 37/189; 37/DIG. 20; 172/108; 172/71

[58] Field of Search ..... 404/98, 84, 90, 75, 404/105, 72; 299/78, 87, 33; 37/108 R, DIG. 1, DIG. 20, 189; 172/4.5, 107, 108, 109; 280/6.1

[56] References Cited

U.S. PATENT DOCUMENTS

| | | | |
|---|---|---|---|
| 1,750,896 | 3/1930 | Lichtenberg . | |
| 1,858,327 | 3/1932 | Hays . | |
| 2,181,320 | 11/1939 | Flynn | 404/90 |
| 2,841,379 | 1/1958 | Driehaus | 299/87 X |
| 3,130,654 | 4/1964 | Apel | 404/104 |
| 3,141,703 | 7/1964 | Gonski | 299/87 X |
| 3,305,271 | 2/1967 | Galis | 299/75 X |
| 3,375,764 | 4/1968 | Petersen | 404/90 |
| 3,375,765 | 4/1968 | Hanson | 404/101 |
| 3,423,859 | 1/1969 | Swisher | 404/90 X |
| 3,429,061 | 2/1969 | Haban | 37/43 |
| 3,468,041 | 9/1969 | Mattson et al. | 37/43 |
| 3,503,450 | 3/1970 | Day | 172/71 |
| 3,533,337 | 10/1970 | Swisher | 404/102 |
| 3,606,827 | 9/1971 | Miller | 404/98 |
| 3,651,588 | 3/1972 | Hanson | 37/108 R |
| 3,693,722 | 9/1972 | Brown | 172/4.5 |
| 3,749,504 | 7/1973 | Smith | 404/84 |
| 3,779,661 | 12/1973 | Godbersen | 404/98 X |
| 3,779,662 | 12/1973 | Smith | 404/98 |
| 3,893,780 | 7/1975 | Gutman | 404/91 |
| 4,041,623 | 8/1977 | Miller | 37/108 R |

*Primary Examiner*—Nile C. Byers, Jr.

*Attorney, Agent, or Firm*—Bell, Seltzer, Park & Gibson

[57] ABSTRACT

An apparatus for concurrently preparing a ground surface and forming a continuous strip of paving material thereon, and which is characterized by the ability to simultaneously grade the ground surface substantially coextensively with the successive slip forming of the pavement material. The apparatus includes a ground trimmer and a following slip former, with the trimmer being laterally translatable with respect to the slip former so that the concurrent grading and slip forming functions can be performed along a curvilinear path while closely maintaining the lateral alignment of the graded ground surface with the successive placement of the paving material. Thus excessive ground surface is not graded, and no area requiring preparation is omitted. The trimmer includes helical flighting mounted on a drive shaft, and a plurality of cutting members arranged on the shaft in predetermined, circumferentially offset relative arrangement which eliminates excessive vibrations and interference with the slip forming operation.

22 Claims, 10 Drawing Figures

APPARATUS AND METHOD FOR FORMING A CONTINUOUS STRIP OF PAVING

FIELD OF THE INVENTION

The present invention relates to a self-propelled apparatus for concurrently grading a ground surface and extruding a continuous, preformed strip of paving material along the graded ground surface.

BACKGROUND OF THE INVENTION

In the course of construction of highway curbs and the like, two distinct operations are required irrespective of the means by which the paving materials are formed into structures. Thus, it is initially necessary to prepare the ground surface upon which the paving material is to be placed in order to remove loose material from the surface and to provide a predetermined depth sufficient to allow the required thickness of paving material. Furthermore, depending upon the methods by which the paving material is placed on the prepared surface, it is also often desirable to prepare a smooth and continuous surface so that the foundation of the paving material will be firm and compact and so that the paving material can obtain a smooth and continuous upper surface.

Following the preparation of the ground surface, the second operation is thereafter performed by placing the paving material on the ground surface and forming such into its desired shape. When extensive and continuous strips such as curbs, ditches, gutters, barrier walls, or the like, are to be formed, the use of a slip form paver has been found efficient and productive of consistent and uniform structures. In operation, paving material such as concrete is fed into a hopper on the paver which opens below into a slip form mold carried by the paver immediately above the ground surface. As the paver progresses, the concrete is extruded from the mold in a profile as determined by the shape of the mold and in a consistency that can be controlled by the forward velocity of the paver or the operation of compacting or extrusion means. In addition, improvements have been made to the paver, such as in U.S. patent to Smith U.S. Pat. No. 3,749,504, that permit automatic control of several functions of the paver. Thus, the direction of the paver and elevation of the mold can be automatically adjusted according to a control line or stringline which defines the predetermined direction and elevation.

During the early course of curb construction, the preparation of the ground surface and the forming of the structure were performed in two separate operations and with different apparatus. One apparatus previously used for surface preparation employs a trimmer having a rotatably mounted, transverse shaft with cutting members projecting radially therefrom. As illustrated in U.S. patents to Miller et al U.S. Pat. No. 4,041,623, and Brown, U.S. Pat. No. 3,693,722, the cutting members were often arranged helically about the shaft so that by the rapid rotation of the shaft substantially all of the ground surface was excavated when the trimmer was passed thereover. A blade or scraper followed the cutting members in order to level and smooth the remaining irregularities.

Because of the traditional design of the trimmer, its compatability with other paving apparatus and, particularly, slip form pavers was limited. Thus, the arrangement of cutting members introduced excessive vibration that was not conducive to the smooth operation required for uniform structures. Furthermore, the unwieldy structure and frequently complicated drive mechanisms of the trimmers restricted their adaptability for simultaneous operation with the pavers.

Attempts have been made to combine the ground preparation and structure formation functions so that both could be performed simultaneously and with the same machine. Thus, as in U.S. patent to Godbersen U.S. Pat. No. 3,779,661, a trimmer of conventional design was disposed laterally in advance of a floating mold, whereby the ground surface is graded at the elevation and position as determined by the position of the paver frame to which the trimmer was mounted. The trimmer is illustrated as having a width substantially greater than the width of the mold, and as will be apparent, the excessive width of the trimmer results in additional preliminary surface preparation and substantially increased operating power.

It has also been proposed to utilize a conventional trimmer of substantially the same lateral width as that of the mold in machines of this type. While this construction reduces power consumption, difficulties were encountered in that the trimmer, which was fixed forwardly of the mold, could not be made to conform to the intended path for the molded strip during curvilinear segments. In this regard, paving machines are conventionally guided by means of an external control line which is positioned in a predetermined relation with respect to the desired positioning of the strip of paving. Where the trimmer was mounted forwardly of the mold, the trimmer would not begin to follow a curvilinear path until the directional control for the mold began to follow the curvature in the control line. Thus, the radius of curvature as defined by the center of the path of the mold and predetermined by the curvature of the control line would not consistently equate with the radius of curvature as defined by the center of the trimmer's path, and the trimmer's path would not be maintained at a constant distance from the control line and in the desired path of the mold. Stated in other words, the trimmer did not have the ability to grade a section of the ground surface in the path of the mold which was toward the center of curvature, and extraneous ground surface area outside the path of the mold and remote from the center of curvature would be graded.

As a consequence of this limitation, the mold would possibly be forced to pass over areas of ground surface that had not been graded, thereby risking damage to the mold and providing an irregular and inconsistent foundation for the structure. Furthermore, the grading operation along inside curves would seemingly interfere with the control line or come prohibitively close to the control line for efficient performance. Also as a result of this deficiency, the rear wheel support on the side of the operation could abruptly change elevation when entering an improperly graded area and constant adjustment would thereby be required. Efficient operation would consequently be inhibited because of the need for continuous attention and correction of the operation.

It is accordingly an object of the present invention to provide a self-propelled apparatus that is adapted to concurrently grade a ground surface and slip form a continuous strip of paving material along the graded surface, such that the ground surface is graded substantially coextensively with the successive placement of the paving material.

It is another object of the present invention to provide a self-propelled apparatus that performs concurrent grading and slip forming operations along a curvilinear path while closely maintaining the lateral alignment of the graded ground surface with the placement of the paving material. In this connection, it is also an object of this invention to provide the means to perform the concurrent grading operation so that the radius of curvature of the graded path, may be made to consistently equate with the radius of curvature of the continuous strip of paving material.

It is a further object of the present invention to provide an apparatus of the described type that avoids grading excessive ground surface to thereby minimize the power requirement, and which also avoids the non-preparation of surface area upon which the paving material is placed.

Another object of this invention is the provision of an apparatus having a transverse trimmer which is adapted to operate without excessive or interfering vibrations whereby the successive grading and slip forming functions can be performed either independently or concurrently.

Still another object of the invention is the provision of a simplified reversible drive system for the trimmer which permits convenient operation in the presence of adjacent obstacles and obstructions, as well as the ready clearing of debris from the trimmer.

SUMMARY OF THE INVENTION

These and other objects and advantages of the present invention are achieved in the embodiment illustrated herein by the provision of a self-propelled apparatus which comprises a frame having a plurality of wheel members supporting the frame and prime mover means mounted on the frame for propelling the apparatus along the ground surface. A mold is carried by the frame for receiving the paving material and forming the same into a continuous strip as the apparatus moves along the ground, and a trimmer is mounted in advance of the mold for grading the ground surface and conveying the excavated ground material to the side thereof. The trimmer is mounted by an arrangement which permits lateral translational movement thereof, and control means is provided for selectively laterally translating the trimmer means during the movement of the apparatus along the ground surface, whereby the trimmer may be made to closely follow the desired path of the paving material.

In the preferred embodiment, the trimmer comprises a housing, a drive shaft rotatably mounted within the housing, helical flighting mounted coaxially about the shaft for conveying the excavated ground material to one side of the trimmer means, and a plurality of cutting members mounted to the shaft to extend radially therefrom and intermediate the flighting, and in a predetermined, circumferentially offset relative arrangement which eliminates excessive vibration. Also, the trimmer includes power means for selectively rotating the shaft about its axis in either direction.

BRIEF DESCRIPTION OF THE DRAWINGS

Some of the objects and advantages of the invention having been stated, others will appear as the description proceeds, when taken in connection with the accompanying drawings, in which.

DESCRIPTION OF THE ILLUSTRATED EMBODIMENT

Figure 1:
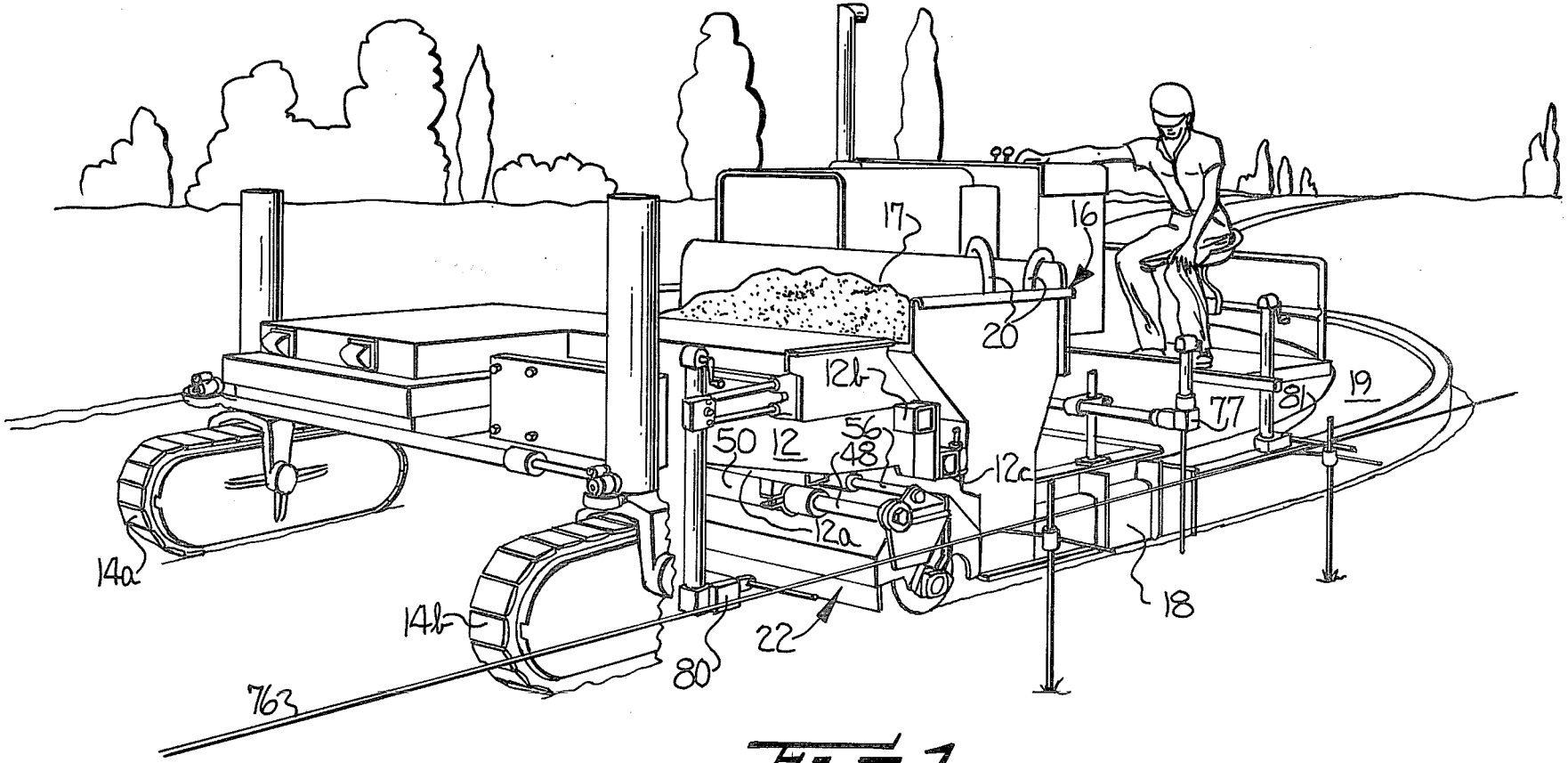
FIG. 1 is a perspective view of an apparatus embodying the features of the present invention, and illustrating the apparatus in operation near the terminus of curvilinear segment of a continuous curb.
Figure 2:
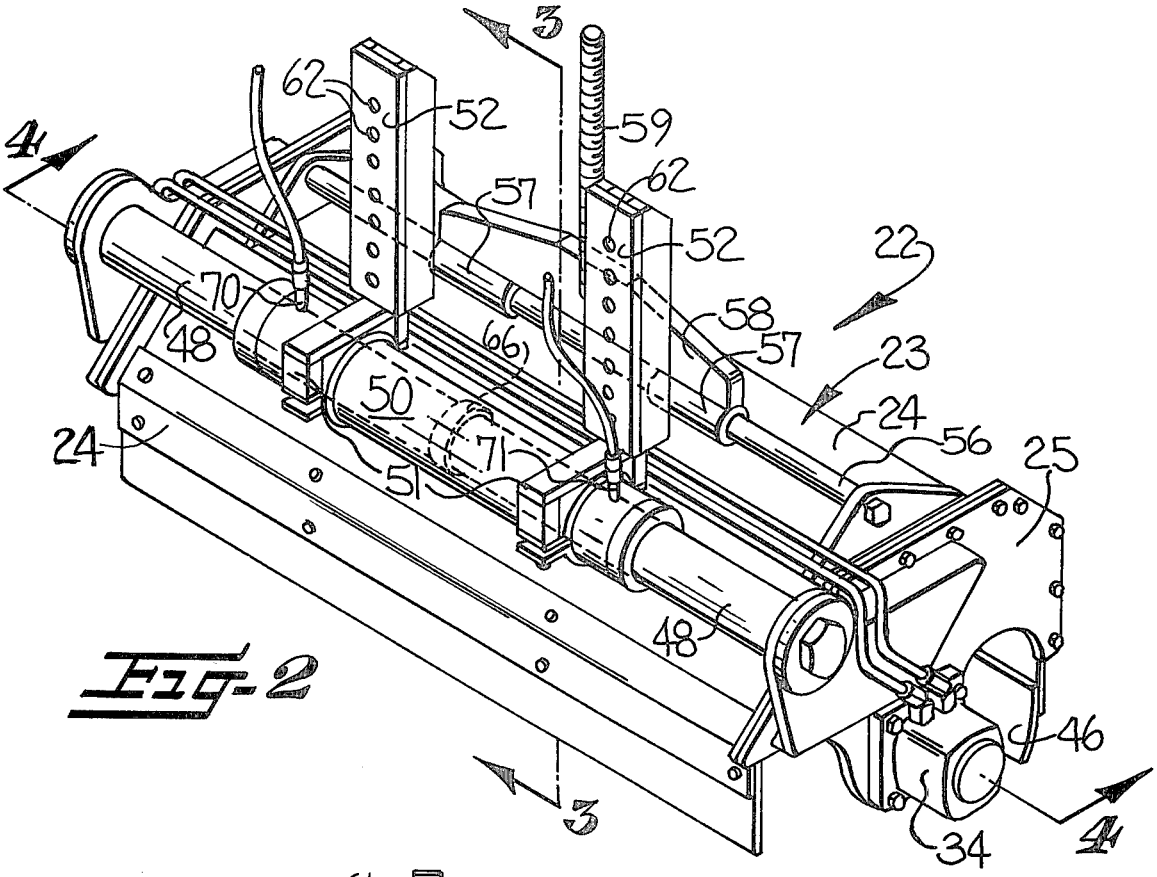
FIG. 2 is a perspective view illustrating the trimmer and its mounting structure of the apparatus shown in FIG. 1.

Referring more specifically to the drawings, the illustrated embodiment of the apparatus is indicated generally at 10 and will be seen to include a curb forming apparatus which has certain common features with the apparatus described in U.S. patent to Smith U.S. Pat. No. 3,749,504, which is incorporated by reference herein. The curb forming apparatus 10 comprises a generally rectangular frame 12 which is supported by a wheel member 14*a*, 14*b*, 14*c*, and 14*d* (note FIGS. 7–10) at each of the four corners. The wheel members are powered by a conventional prime mover and hydraulic system (not shown) to thereby propel the apparatus along the ground surface.

A slip form mold 16 is mounted to the frame 12, whereby paving material can be received in the upper hopper portion 17 thereof and deposited on the ground surface through the mold portion 18 which has an open bottom and open rear end. In this manner, a finished curb 19 (FIG. 1) is deposited as the apparatus progresses and in a predetermined configuration according to the profile of the mold portion 18. Continuous strips of paving material such as concrete or the like can thereby be formed into uniform structures including curbs, ditches, gutters, and barrier walls. Also provided are conventional vibrators 20, powered by an electrical or hydraulic system (not shown), and which extend into the hopper portion 17 to compact and densify the paving material. The means for mounting the mold 16 to the frame of the apparatus includes mounting sleeve supports 15 which are fixed to the frame member 12*c*, note FIG. 3.

Figure 4:
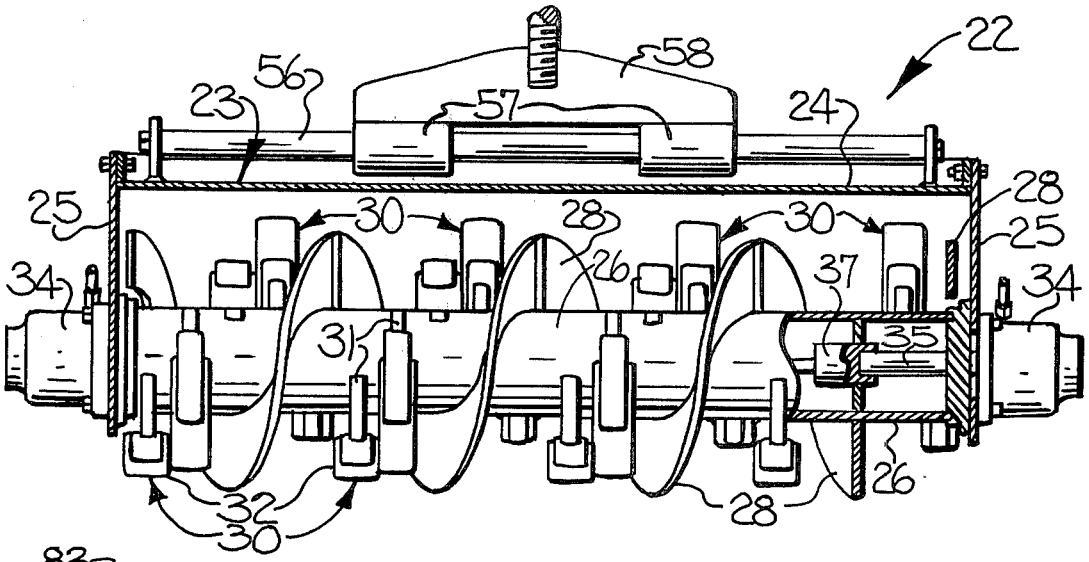
FIG. 4 is a sectional front view of the trimmer and mounting structure, and taken substantially along the line 4—4 of FIG. 2.

In accordance with the present invention, the apparatus 10 further includes means mounted to the frame immediately in advance of the mold 16 for grading the ground surface and for conveying the excavated ground material to the side thereof. This grading and conveying means comprises a trimmer 22 which includes an elongate housing 23 which comprises a cover 24, end walls 25, and an open bottom. As best illustrated in FIG. 4, a drive shaft 26 is rotatably mounted between the end walls 25 of the housing 23 and defines a horizontal rotational axis. Coaxially about the shaft 26, a helical flighting 28 is secured and thereby functions as a screw conveyor to transmit loose objects or ground material to one end of the shaft 26 when the shaft is rapidly rotated about its axis. Typically, the flighting has a diameter of about 16 inches. In its usual manner of operation, the shaft 26 is rotated so that its forward periphery is ascending. Thus, if the trimmer 22 is mounted on the left side of the frame 12 as illustrated in FIG. 1, the helical flighting 28 is oriented in a right-handed convention whereby the ground material is conveyed to the inside or under the frame. Other combinations are also possible to accommodate varying conditions, as where it is desirable to transmit the material to the outside of the apparatus.

Figure 3:
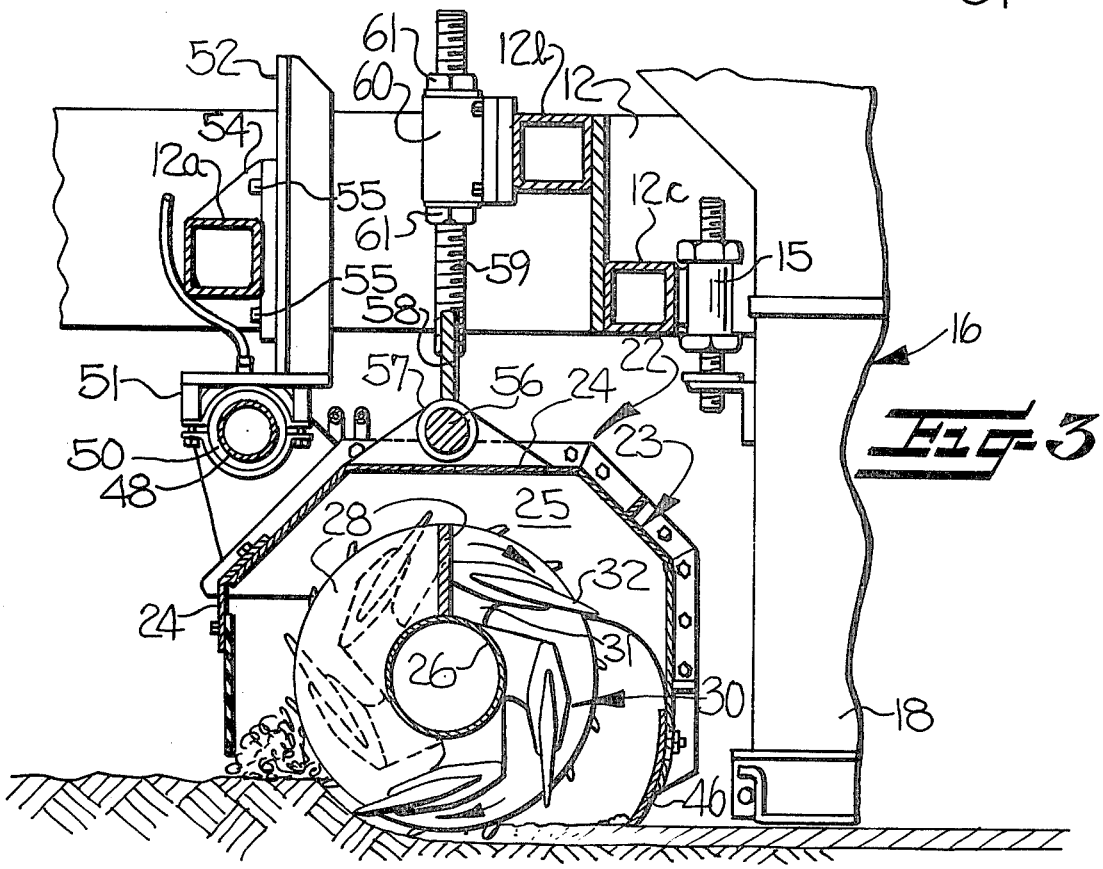
FIG. 3 is a sectional side view of the trimmer and mounting structure taken substantially along the line 3—3 of FIG. 2, and further illustrating portions of the frame and mold of the apparatus.

A plurality of cutting members 30 are mounted to the drive shaft 26 in the channel intermediate the flighting 28, whereby the ground surface can be excavated when the shaft is rotated. Each cutting member 30 comprises a tooth support 31 which is fixedly secured to the shaft 26 and which projects substantially outwardly from the shaft in a radial direction and perpendicular to the shaft axis, as best shown in FIGS. 3 and 4. A cutting tooth 32 is releasably mounted to each tooth support 31, and in the illustrated embodiment such mounting consists of wedging the tooth in a slotted opening formed in the end of the tooth support. Thereby, the tooth 32 can be conveniently removed by forcibly dislodging the tooth from its support, while the rotation of the shaft assists in retaining the tooth in position. Each tooth 32 projects substantially perpendicularly from its associated tooth support 31 and in the direction of its rotation about the shaft axis. As shown in FIG. 3, the extremity of each cutting tooth 32 extends radially slightly beyond the outer periphery of the flighting 28. By this arrangement, the cutting members 30 act to successively cut an arcuate segment of the ground surface when the shaft 26 is rapidly rotated.

In order to eliminate excessive vibration which may interfere with the slip form mold 16 and the formation of smooth, uniform structures, the cutting members 30 are secured to the drive shaft 26 in a predetermined arrangement that asymmetrically distributes the impact resulting from the excavating function of the cutting teeth 32. In the illustrated embodiment, the cutting members 30 are mounted spirally about the drive shaft 26 and within the channel formed between the flighting 28. Furthermore, each cutting member 30 is laterally spaced and circumferentially offset from each of the other cutting members so that only one cutting member will strike the ground surface at any given time and so that the cutting members strike the ground at regular intervals when the drive shaft 26 is rotated about its rotational axis. Thus as illustrated, nineteen teeth 32 are mounted spirally to the shaft and are spaced so that each succeeding tooth in the spiral is approximately 76 degrees circumferentially from its predecessor. Also, the teeth successively strike the ground after about each 19 degrees of rotation.

Figure 6:
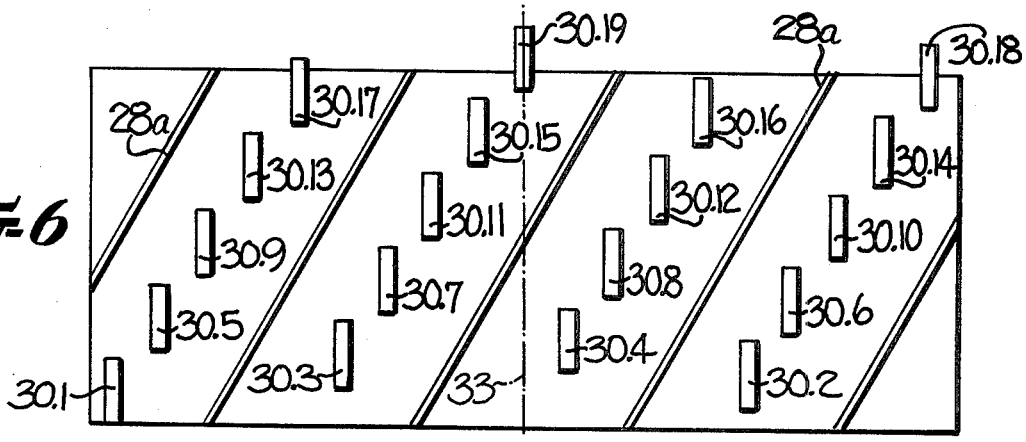
FIG. 6 is a schematic diagram illustrating the pattern in which the cutting members of the trimmer strike the ground.
Figure 7:
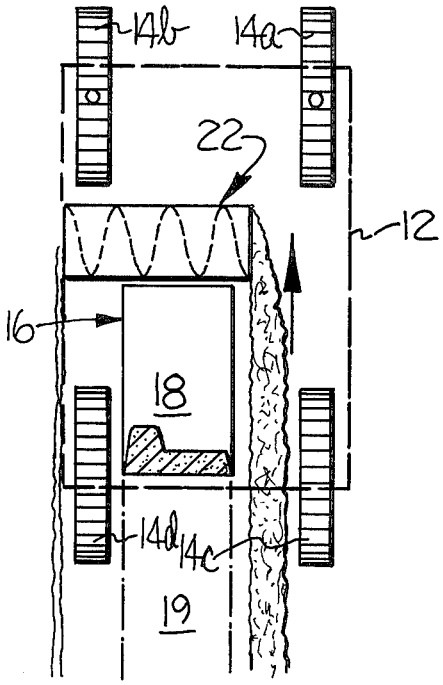
FIG. 7 is a schematic plan view of the apparatus illustrating the mold and trimmer at the center mounted position.
Figure 8:
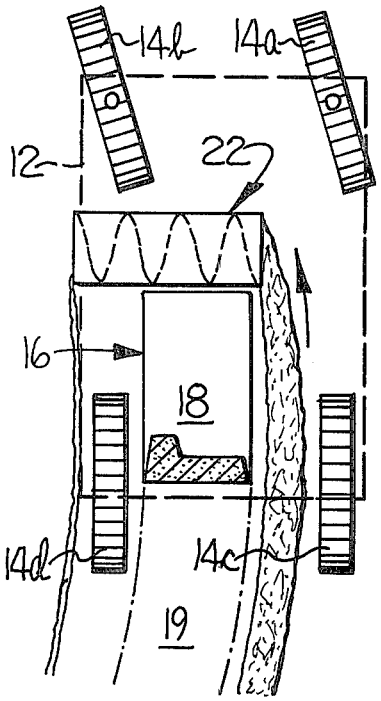
FIG. 8 is a view similar to FIG. 7 and illustrating the apparatus during a turn.

A further aspect of the arrangement prescribes the relation of each cutting member 30 to its laterally adjacent neighbors, and is illustrated schmatically in FIG. 6. FIG. 6 represents an area of the ground surface over which the trimmer has moved, with the flighting rolling without slippage through one revolution. The lateral lines **28*a* indicate the flighting, the areas between the lines 28*a* represent the channel formed by the flighting, the areas 30.1–30.19 represent the arcuate segments cut by the respective cutting members, and the line 33 represents a centerline which passes perpendicularly to the axis of the drive shaft 26. The sequence in which the cutting members strike the ground is illustrated by the sequential numbering of the cut segments 30.1–30.19 in FIG. 6**.

As will be apparent from FIG. 6, the cutting members 30 are circumferentially offset in a predetermined relative arrangement so as to sequentially strike the ground on opposite sides of the centerline 33. This fact, coupled with the relatively high frequency of the impacts, serves to minimize the tendency of the trimmer to twist about its centerline 33. As will be apparent, any such twisting vibrational forces imparted to the trimmer is undesirable since the resulting movement will be conveyed to the mold 16, causing it to shake and upset the formed paving material.

To further describe the orientation of the cutting members 30, it will be seen from FIG. 6 that in the majority of instances, cutting members from laterally non-adjacent portions of the channel strike the ground in sequence. Thus for example, the cutting members which form areas 30.1 and 30.2 strike the ground in sequence, and are located in laterally non-adjacent portions of the channel. Similarly, the cutting member forming area 30.3 is in a portion of the channel which is laterally non-adjacent to the portion containing the area 30.2. It is preferable that for each cutting member, its immediate laterally adjacent neighbors will not strike the ground either immediately before or immediately after the subject cutting member. However, in the case in which the cutting members are spirally mounted around the shaft in less than about five revolutions, some succession will be necessary. Thus as illustrated, the cutting member which forms area 30.8 strikes the ground in sequence with the member forming area 30.9 and which is in an adjacent portion of the channel. However, the sequence is predominantly irregular along the length of the drive shaft 26, and this irregular sequence of the cutting members will distribute the impact so that a continuous transverse vibration will not be present. Other combinations within the criteria are possible and will produce an equally desirable result.

To selectively rotate the shaft 26 about its axis, power means is provided and comprises a reversible hydraulic motor 34 secured to each end wall 25 of the housing 23 and operatively connected to the adjacent end of the drive shaft 26. More particularly, the output spline shaft 35 of each hydraulic motor 34 extends through the end wall 25 and a fixed concentric plate 36 to engage a coupler 37 which is fixed to the interior of the shaft 26. As illustrated schematically in FIG. 5, pressurized hydraulic fluid is supplied to the hydraulic motors 34 by a variable displacement overcenter piston pump 38 which is operatively connected to the fluid reservoir 39. The pump 38 is arranged in a closed loop hydrostatic transmission, whereby the operator of the apparatus can drive the trimmer in either direction, and at variable speeds in either direction. In this regard, the ability to reverse the direction of rotation of the trimmer is advantageous in that the cutting members occasionally become clogged with wire or other debris, and reverse movement facilitates the removal of such debris. A prime mover 43, which typically comprises an internal combustion engine, drives the hydraulic pump 38, and preferably also powers the above described hydraulic system for propelling the apparatus.

For completing the preparation of the ground surface excavated by the cutting members, an elongate scraper blade 46 is mounted on the side of the housing 23 adjacent the mold 16 and extends laterally along the length of the trimmer. Also, the blade 46 is mounted so as to extend substantially perpendicularly toward the ground surface. Thereby, when the blade 46 is properly positioned as hereinafter described, the ground surface will be leveled as the apparatus progresses. In the illustrated embodiment, the blade 46 is vertically slotted (not shown) and is mounted to the housing 23 by bolts received through the slots so that adjustment can be made to the blade's vertical position at the point of attachment to the housing.

The trimmer 22 is mounted to the frame 12 in advance of the slip form mold 16, whereby the ground surface is prepared prior to the formation of the paving structure on the surface. Furthermore, the trimmer 22 is essentially independent of the operation of the mold 16 to the extent that the trimmer can be operated either simultaneously with the mold or alone.

The apparatus 10 further comprises means for mounting the trimmer 22 to the frame 12 in a manner which permits lateral translational movement of the trimmer with respect to the frame. More particularly, the trimmer is mounted by an arrangement which includes a mounting shaft 48 fixed to the forward end of the housing 23 and coaxially and slideably disposed within a horizontal sleeve 50. As best seen in FIG. 3, the common axis of the shaft 48 and sleeve 50 is parallel to and forwardly offset from the axis of the drive shaft 26. Clamps 51 secure the sleeve 50 to vertical members 52 that in turn are secured to the frame member 12*a* by means of the mounting bracket 54 and fasteners 55.

The mounting means further comprises a rod 56 fixed to the medial portion of the housing 23, and disposed along a horizontal axis parallel to and rearwardly offset from the axis of the shaft 48 and sleeve 50, and parallel to and above the axis of the drive shaft 26. The rod is slideably disposed within tubular fitting portions 57 of a bracket 58. The bracket 58 includes a threaded vertical arm 59 received through a cylindrical support member 60, which is mounted to the frame member 12*b*, and secured in place by nuts 61 that lock against the ends of the cylindrical support member 60. Thereby, the vertical position of the trimmer 22 can be adjusted with respect to the frame by rotating the nuts 61 in the appropriate direction so that the vertical arm 59 and the housing 23 may be raised or lowered. The vertical members 52 also include a series of apertures 62 which are vertically aligned to permit the selective vertical positioning of the forward end of the housing 23. Thus, the fasteners 55 may be disposed through selected apertures at the same elevational position to thereby raise and lower the housing 23.

As illustrated in FIG. 3, the adjustment of the vertical arm 59 will adjust the relative depth of operation of the cutting members 30 and the scraper blade 46. When the vertical arm 59 is raised, the housing 23 is pivoted about the axis of the mounting shaft 48 and the scraper blade 46 is elevated a greater distance than the drive shaft 26 so that the depth of leveling will be raised with respect to the depth of excavation. In a similar manner, the depth of leveling can be lowered with respect to the depth of excavation by lowering the vertical arm 59.

Figure 5:
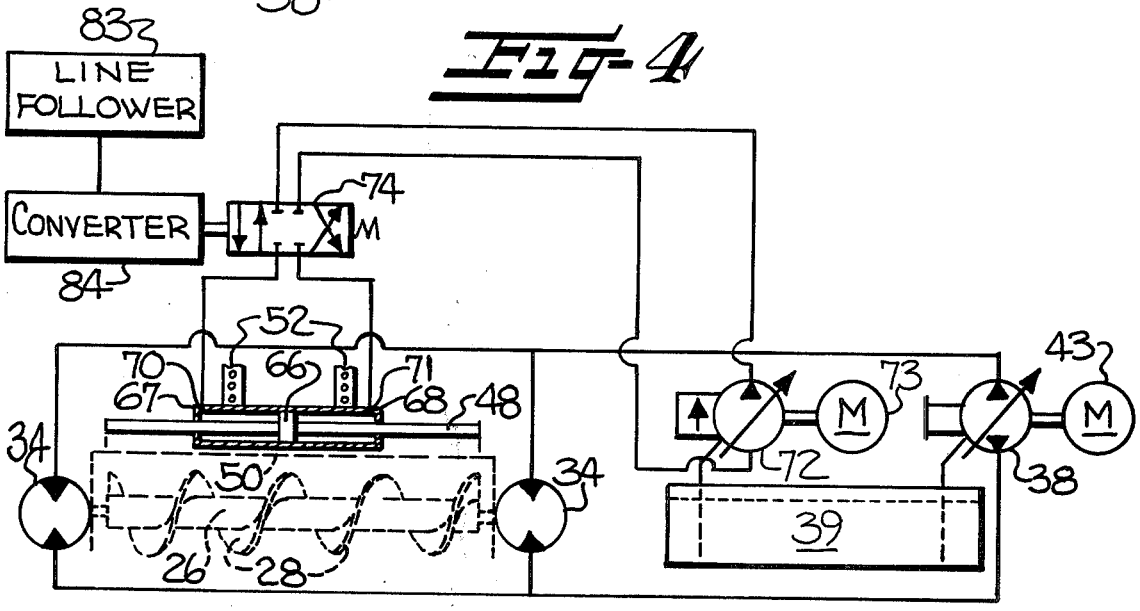
FIG. 5 is a schematic diagram of the control means for selectively laterally translating the trimmer and power means for selectively rotating the drive shaft of the trimmer.

To selectively laterally translate the trimmer 22 with respect to the frame 12, control means is provided and, as illustrated schematically in FIG. 5, includes a piston 66 mounted on the mounting shaft 48 and centrally and slideably disposed in the sleeve 50. Each end of the sleeve 50 is sealed to the mounting shaft so that fluid chambers 67 and 68 are formed on each side of the piston 66 but so as to allow slideable movement of the mounting shaft 48. Ports 70 and 71 extend through each end of the sleeve 50 and communicate with the associated chamber 67 and 68 respectively. Thus, pressurized hydraulic fluid can be supplied to either chamber and exhausted from the other to move the piston 66 within the sleeve 50 and to position the trimmer 22 with respect to the frame 12. A pressure compensated variable displacement pump 72, powered either by a separate motor 73, or the motor 43, supplies pressurized hydraulic fluid to the chambers 67, 68 and a flow control valve 74 is disposed therebetween so that the pressurized fluid can be selectively directed through either port 70 and 71 into the associated chamber, while permitting the other chamber to exhaust through its associated port. In one specific example, the above mounting means for the trimmer permits it to be moved laterally about 12 inches in each direction from its central position.

Figure 9:
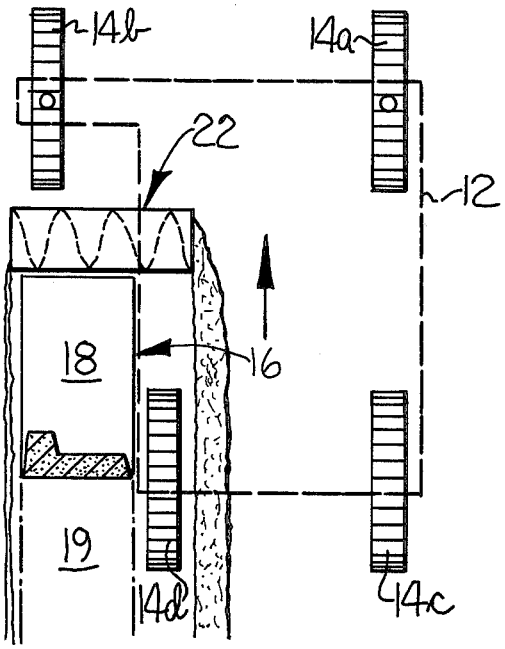
FIG. 9 is a view similar to FIG. 7 but illustrating the mold and trimmer at the offset position.
Figure 10:
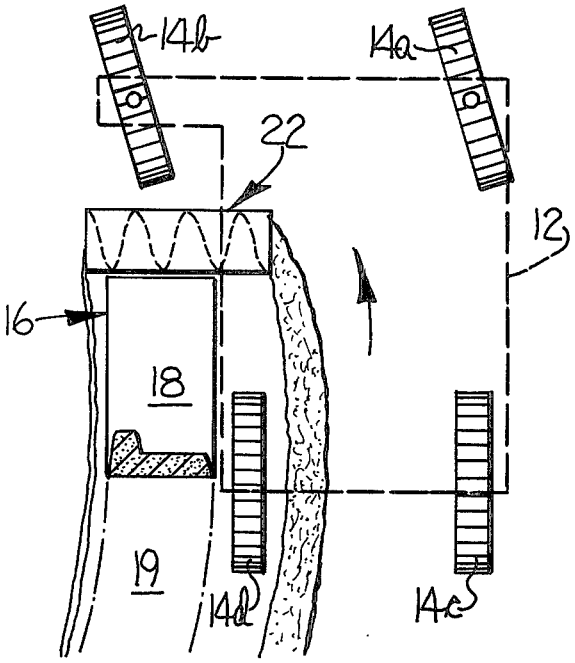
FIG. 10 is a view similar to FIG. 9 and illustrating the apparatus during a turn.

The apparatus 10 is adapted to be operated in two different configurations as job conditions dictate. In one configuration, illustrated in FIGS. 7 and 8, the mold 16 and trimmer 22 are mounted centrally within the frame 12, and in its second configuration, the mold and trimmer are offset along the left side of the apparatus, note FIGS. 1 and 9–10. In this regard, it will be understood that the frame members 12*a*, 12*b*, and 12*c* include suitable additional supports 54, 60, and 15 at a central location for mounting the mold and trimmer in its central position. The left front wheel member 14*b* is preferably movably mounted to the frame by conventional means which permits it to be selectively moved between a first position where it is aligned with the rear wheel member 14*d* (FIG. 7–8), and a second laterally offset position (FIGS. 9–10). The offset position is particularly desirable for improving traction and stability when the mold and trimmer are in their offset position. In addition, the frame 12 is preferably laterally extensible in a conventional manner so that a mold of extended lateral width can be accommodated to form wide structures.

To automatically guide the apparatus along the ground surface, an external control line or stringline 76 is provided. As is well known in the art, the control line 76 is positioned in accordance with the desired placement of the curb 19, both with regard to its lateral location and elevation. A line follower 77 detects the lateral deviation of the frame 12 from a predetermined position with respect to the control line 76 and generates an output signal in response thereto. Direction control means (not shown) is responsive to the signal and selectively changes the direction of the apparatus through interaction with the wheel members 14 to re-establish the predetermined direction thereof. Similarly, line followers 80 and 81 detect the elevational deviation of the frame 12 from the control line 76, and elevation control means responsive to output signals generated by the line followers 80 and 81 raises and lowers the frame with respect to the wheel members 14 to re-establish the predetermined elevation. A level sensor means (not shown) may also be provided whereby the sides of the frame 12 can be maintained in a predetermined level or non-level relationship. Further details regarding the means for automatically controlling the direction of movement, for automatically adjusting the elevation of the mold, and for automatically maintaining a predetermined level condition, may be obtained by reference to the above noted patent to Smith.

The trimmer 22 has a length in the lateral direction substantially less than the overall lateral width of the apparatus 10. Viewing FIGS. 7–10, it will be observed that the length of the trimmer 22 is at least as great, and preferably just slightly greater, than the overall lateral width of the mold 16 and adjacent left rear wheel member 14*d*. As one specific example, the mold has a width of 36 inches, the rear wheel member has a width of 8 inches, and the trimmer 22 has a length of 53 inches. This configuration, and the fact that the trimmer is laterally translatable, permits the trimmer to grade only the ground over which both the mold and wheel member 14*d* move, even during turns, and excessive ground area is not graded. In this regard, it is advantageous that the wheel member 14*d* operate on trimmed grade, since the outlet of the mold is adjacent the centerline of that wheel mamber, and thus that wheel member is most important in determining the height of the paving. As will be apparent, any undue vertical movement of the wheel member 14*d* would render it difficult to obtain a uniform and proper elevation of the paving.

In operation, the control line 76 is positioned along the previously rough-graded ground surface and in accordance with the desired direction and elevation of the curb structure. The apparatus 10 is brought to one end of the control line, and the line followers 77, 80, and 81 are adjusted and the level sensor means is set so that the mold will be positioned at the desired distance from the control line and in the desired orientation. The trimmer 22 is laterally translated by operation of flow control valve 74 until positioned directly in advance of the mold 16. Upon completion of preliminary adjustments, including setting the depth of excavation and the depth of leveling, the apparatus 10 is propelled along the surface while paving material is deposited in the upper hopper portion 17 and the trimmer 22 is operated for excavation by valve 42. Typically, the apparatus is advanced at a speed of about 15 feet per minute, and the trimmer is rotated at a speed of between about 90 to 180 rpm.

Since the line follower 77 is positioned directly adjacent the mold 16 and the direction control means is adjusted so that the mold is maintained at a constant predetermined distance from the control line 76, in operation on curvilinear sections of the predetermined path, the side of the frame 12 adjacent the control line 76 will tend to approach the control line on inside curves (such as is illustrated in FIG. 1) and will tend to deviate outwardly from the control line on outside curves. If the trimmer 22 is maintained in a constant lateral position with respect to the frame, the path graded thereby will not remain at a constant distance from the control line 76 on curvilinear segments and such graded path will not precisely correspond to the successive placement of the curb structure. Thus, as the apparatus 10 approaches a curvilinear segment, the operator positions the trimmer 22 by manual operation of the valve 74 so that the constant distance from the control line is maintained. Similarly, when the apparatus leaves a curvilinear segment, adjustment of the lateral position of the trimmer 22 is made in the opposite direction, and thereby, the lateral alignment of the graded ground surface will be substantially coextensive with the placement of the paving material.

Alternatively, and as schematically illustrated in FIG. 5, an additional line follower 83 can be disposed adjacent the trimmer 22 and adapted to produce an output signal in response to directional deviations of the frame 12 from the control line 76 or in response to lateral deviations of the trimmer 22 from the predetermined distance to the control line. Positional control means would be responsive to an output signal from the line follower 83 to selectively operate the flow control valve 74, which is operatively connected through an electrical transducer or converter 84 to the line follower 83. Thereby, the lateral position of the trimmer 22 would be automatically adjusted.

In the drawings and specification, there has been set forth a preferred embodiment of the invention and although specific terms are employed, they are used in a generic and descriptive sense only and not for purposes of limitation.

That which is claimed is:

1. A self-propelled apparatus for concurrently grading a ground surface and slip forming a continuous strip of paving material along the graded ground surface, characterized by the ability to grade the ground surface substantially coextensively with the successive placement of the paving material, and wherein the concurrent grading and slip forming operations can be performed along a curvilinear path while closely maintaining the lateral alignment of the graded ground surface with the placement of the paving material, and comprising a frame;

prime mover means mounted on said frame for propelling said apparatus along the ground surface and including a plurality of wheel members supporting said frame;

mold means carried by said frame for receiving the paving material and forming the same into a continuous strip of predetermined lateral width as the apparatus moves along the ground;

trimmer means having a length in the lateral direction substantially less than the overall lateral width of the apparatus for grading the ground surface and for conveying the excavated ground material to the side thereof;

means mounting said trimmer means laterally to said frame and in advance of said mold means and so as to permit lateral translational movement thereof; and control means mounted on said frame for selectively laterally translating said trimmer means during movement of the apparatus along the ground surface, and so that said trimmer means may be made to closely follow the desired placement of said strip of the paving material.

2. The apparatus as defined in claim 1 wherein said trimmer means comprises a housing, a drive shaft rotatably mounted within said housing and defining a horizontal rotational axis which extends laterally with respect to said frame, helical flighting mounted coaxially about said shaft to define a screw conveyor, a plurality of laterally spaced cutting members mounted to said shaft intermediate said flighting for excavating the ground surface when said shaft is rotated, and power means operatively related to said housing for selectively rotating said shaft about said axis, whereby upon rotation of said shaft said cutting members excavate the ground surface and the loosened material is conveyed laterally by said helical flighting.

3. The apparatus as defined in claim 2 wherein each of said cutting members comprises a tooth support fixedly mounted to said drive shaft so as to project substantially radially from said shaft, a cutting tooth, and means for releasably mounting said tooth to said tooth support so as to project substantially perpendicularly from said tooth support and in the direction of its rotation about said axis, whereby each of said cutting members will successively cut an arcuate segment of the ground surface when said shaft is rotated.

4. The apparatus as defined in claim 2 wherein said cutting members are spirally mounted to said drive shaft and in the channel defined between said flighting.

5. The apparatus as defined in claim 4 wherein said cutting members are circumferentially offset from each other and so that they strike the ground at regular intervals when said drive shaft is rotated about said rotational axis.

6. The apparatus as defined in claim 5 wherein said cutting members are circumferentially offset in a predetermined relative arrangement so as to sequentially strike the ground on opposite sides of a centerline passing perpendicularly to the axis of said drive shaft.

7. The apparatus as defined in claim 2 wherein said means for mounting said trimmer means comprises a horizontally disposed sleeve fixed to one of said frame and housing, and defining an axis disposed parallel to and offset from said rotational axis of said drive shaft, and a mounting shaft fixed to the other of said frame and housing and being coaxially and slideably disposed within said sleeve.

8. The apparatus as defined in claim 7 wherein said control means comprises fluid means for selectively moving said mounting shaft axially in either direction with respect to said sleeve.

9. The apparatus as defined in claim 8 wherein said fluid means comprises a piston mounted on said mounting shaft and being centrally and slideably disposed in said sleeve, means for sealing each end of said sleeve to said mounting shaft to define a fluid chamber on each side of said piston, a port extending through each end of said sleeve and communicating with the associated chamber, a pressurized fluid source, and valve means for selectively directing pressurized fluid through either port and into the associated chamber, while permitting the other chamber to exhaust through its associated port.

10. The apparatus as defined in claim 9 wherein said trimmer means further comprises elongate scraper blade means mounted on the side of said housing adjacent said mold means and extending laterally along the length thereof, for leveling the ground surface following excavation thereof.

11. The apparatus as defined in claim 10 wherein said means for mounting said trimmer means further comprises a bracket including a tubular fitting portion, means mounting said bracket to one of said frame and housing so as to permit relative vertical adjustment therebetween, and with said tubular fitting portion being disposed along a horizontal axis which is parallel to and offset from each of the common axis of said sleeve and mounting shaft, and said rotational axis of said drive shaft, and a rod fixed to the other of said frame and housing and being coaxially and slideably disposed in said tubular fitting portion, whereby adjustment of the relative vertical position of said bracket acts to relatively rotate said sleeve and mounting shaft about their common axis and to thereby control the depth of excavation by changing the elevation of said drive shaft.

12. The apparatus as defined in claim 9 wherein said control means further includes a line follower adapted to produce an output signal in response to directional variations of an externally positioned control line, and means responsive to the output signal for operatively controlling said valve means, whereby the lateral position of said trimmer means is automatically adjusted as the apparatus moves along the ground.

13. The apparatus as defined in claim 2 wherein said power means for selectively rotating said shaft comprises a reversible hydraulic motor mounted at each end of said housing and operatively connected to said drive shaft, a pressurized hydraulic fluid source, and means for selectively directing pressurized hydraulic fluid to said hydraulic motors for concurrent rotation in either direction.

14. The apparatus as defined in claim 1 further comprising means mounted on said frame for automatically controlling the direction of movement of the apparatus in accordance with an external control line, means mounted on said frame for automatically adjusting the elevation of said mold means according to the elevation of the external control line, and means mounted on said frame for automatically maintaining a predetermined level or non-level relationship between the sides of the apparatus.

15. The apparatus as defined in claim 1 wherein said trimmer means has a length at least as great as the overall lateral width of the mold means and one adjacent rear wheel member, whereby the trimmer means grades the ground surface over which both the mold means and said one wheel member moves.

16. A trimmer for grading the ground surface and adapted for operation with a slip form paver or the like, and characterized by the absence of excessive vibrations during operation, and comprising a housing, a drive shaft rotatably mounted within said housing and defining a longitudinal rotational axis;

helical flighting mounted coaxially about said shaft and defining a helical channel between the flighting, a plurality of cutting members mounted to said shaft in a helical arrangement and within said channel, said cutting members being circumferentially and laterally offset from each other so that they strike the ground at regular intervals and such that in the majority of instances, cutting members from laterally non-adjacent portions of the channel strike the ground in sequence, and power means mounted to said housing for selectively rotating said shaft.

17. The trimmer as defined in claim 16 wherein each of said cutting members comprises a tooth support fixedly mounted to said drive shaft, and a cutting tooth releasably mounted to the outer extremity of said tooth support.

18. The trimmer as defined in claim 17 wherein said power means comprises a hydraulic motor mounted at each end of said housing and operatively connected to said drive shaft.

19. The trimmer as defined in claim 16 further comprising an elongate scraper blade, and means for mounting said blade to said housing so as to extend in a direction parallel to said rotational axis of said drive shaft and so as to permit adjustment of the elevation of the blade with respect to that of said drive shaft.

20. A method of forming a continuous strip of paving material along a graded ground surface and comprising the steps of excavating and leveling the ground surface by moving a trimmer along a path of travel, while continuously depositing a paving material upon the excavated and leveled ground surface to form a continuous strip of paving material and including moving a slip former along the excavated and leveled ground surface immediately downstream of the trimmer, while controlling the direction of movement of both the trimmer and slip former in accordance with the direction of an external control line, and including moving the trimmer independently of the slip former during movement along curvilinear portions of the path of travel, whereby the excavated and leveled ground surface and the strip of paving may be closely aligned during all portions of the path of travel.

21. The method as defined in claim 20 comprising the further step of controlling the elevation of both the trimmer and slip former in accordance with the elevation of the external control line.

22. The method as defined in claim 21 wherein the step of excavating and leveling the ground surface includes conveying the excavated ground material to one side of the path of travel of the trimmer.

* * * * *